US009133693B2

(12) United States Patent
Wasa Tverlid

(10) Patent No.: US 9,133,693 B2
(45) Date of Patent: Sep. 15, 2015

(54) EXPANDABLE PIPE SECTION

(75) Inventor: Steinar Wasa Tverlid, Bjørøyhamn (NO)

(73) Assignee: STATOIL PETROLEUM AS, Stavanger (NO)

( * ) Notice: Subject to any disclaimer, the term of this patent is extended or adjusted under 35 U.S.C. 154(b) by 907 days.

(21) Appl. No.: 13/378,325

(22) PCT Filed: Jun. 15, 2010

(86) PCT No.: PCT/EP2010/058401

§ 371 (c)(1),
(2), (4) Date: Mar. 2, 2012

(87) PCT Pub. No.: WO2010/146057

PCT Pub. Date: Dec. 23, 2010

(65) Prior Publication Data

US 2012/0160479 A1 Jun. 28, 2012

(30) Foreign Application Priority Data

Jun. 15, 2009 (NO) ..... 20092299

(51) Int. Cl.
*F16L 15/00* (2006.01)
*E21B 43/10* (2006.01)

(52) U.S. Cl.
CPC ..... *E21B 43/106* (2013.01)

(58) Field of Classification Search
USPC ..... 285/333, 355, 390, 392
See application file for complete search history.

(56) References Cited

U.S. PATENT DOCUMENTS

| | | | | |
|---|---|---|---|---|
| 2,909,380 | A * | 10/1959 | Hoye et al. | 285/333 |
| 4,004,832 | A * | 1/1977 | Connelly | 285/333 |
| 5,427,418 | A * | 6/1995 | Watts | 285/94 |
| 6,481,760 | B1 | 11/2002 | Noel et al. | |
| 7,753,416 | B2 * | 7/2010 | Mazzaferro et al. | 285/333 |
| 2003/0106618 | A1 | 6/2003 | Baugh et al. | |
| 2010/0225107 | A1 | 9/2010 | Tverlid | |

FOREIGN PATENT DOCUMENTS

| | | | |
|---|---|---|---|
| GB | 2 445 309 | A | 7/2008 |
| NO | 20083915 | L | 9/2008 |
| WO | 2006/073861 | A1 | 7/2006 |
| WO | 2007/016074 | A1 | 2/2007 |

* cited by examiner

*Primary Examiner* — Aaron Dunwoody
(74) *Attorney, Agent, or Firm* — Birch, Stewart, Kolasch & Birch, LLP

(57) ABSTRACT

An expandable pipe section, intended to be joined with a corresponding pipe section for use in connection with a well casing of a production well for hydrocarbons, where the pipe section is configured to be screwed on or off an adjoining expandable pipe section, the pipe section at one end being provided with a male end having externally arranged threads and where the adjoining expandable pipe section is provided with a correspondingly shaped female end having corresponding internal threads. The distance between adjacent threads at their widest point is less than the maximum width of a thread. Those parts of the pipe being provided with threads are provided with at least two step wise arranged parts with a cylindrical surface being coaxially arranged with the pipe wall(s).

16 Claims, 4 Drawing Sheets

$b_2/b_1$="slenderness factor" governed by a (which changes h)

EXPANDABLE PIPE SECTION

TECHNICAL FIELD

The present invention relates to a joinable or separable, expandable pipe formed of a number of pipe sections intended to be jointed for use in relation to a well casing in a production well for hydrocarbons. Each pipe section is configured to be screwed on to or off an adjoining expandable pipe section, each pipe section at one end being provided with a male end having external threads and where the corresponding end of an adjoining expandable pipe section is provided with a corresponding female end with correspondingly adaptable internal threads. The threads may preferably have a more or less circular or oval shaped thread root and thread crest. The pipes are preferably of the type being suitable for use in connection with casings or liners in hydrocarbon producing well.

BACKGROUND

Wells producing hydrocarbons are provided with pipes made of relatively thin pipes functioning as casings. Casings are formed by jointing a large number of pipe sections. Each pipe section is at one end provided with a male end having externally arranged threads, while the opposite end is provided with a female end having internally arranged threads, adapted to the threads on the male end, the casing being extended by screwing a pipe section with its male end into a female end of an adjacent pipe section. Such jointed pipe sections are run unexpanded down into a well. When the casing has reached it position cement may, if required, be run down through the unexpanded casing in order to fill the annulus between the hole of the well bore and the casing with cement. The unexpanded casing is then expanded by driving a cone body having a larger diameter than the diameter of the unexpanded casing down into casing. Such conical bodies are often a cone which may be made of a large steel element or made of several assembled smaller sector shaped elements. Alternatively, the cone may also comprise of cylindrical rollers having somewhat skewed or slanted axes with respect to the longitudinal axis of the pipe. It is also possible to apply hydraulic excess pressure in order to deform the pipe, where such excess pressure preferably may be used in combination with one of the conventional expansion methods.

With casings of this type there is a need for maintaining a threaded joint which is both structurally intact and also is gas tight preferably prior to, but in particular, subsequent to expansion, since such a casing often is positioned in a formation with an external or internal gas pressure, and since there always is a requirement of controlling the pressure inside the gas pipe.

In the expansion phase of the installation there is a problem that the threaded joint due to the radial and partly also axial expansion may loosen, since the threaded connection between the male end of one pipe section and the female end of an adjoining pipe section during this operation will be bent at least twice, unless the expansion also is based upon hydraulic expansion. The first bending occurs at the moment when the conical surface of the expansion tool hits that part of the pipe, then when the curving stretches out due to the cone movement along the joint, and then due to the curving the pipe is given when the cone is leaving and finally when the cone is pulled out.

Studies and simulations of the expansion indicate that in particular the internal start of a threaded joint of the casing and the corresponding external end of the threaded joint of the casing are exposed in particular to radial stresses, loads and movements as a consequence of the expansion.

When designing the end sections to be jointed with each other by means of a threaded joint, there is in particular a need for a joint which amongst others is suitable for remaining in locked and gas tight engagement even during the phase where the thin walled pipe is expanded and also subsequent to the expansion. Likewise there is a need for a pipe joint which may withstand cyclic loads and fatigue, tensional loads and compressive loads, and bending moments, and in certain instances also the rotational moment, without risking that the threaded joint unintentionally is loosened or weakened in any way, for example during running of such a pipe string down into a deviating well.

From US 2003/01937376 a threaded joint for pipe sections is known, jointed to form a pipe line for transport of hydrocarbons. The object of this solution is to be able to resist radial plastic expansion of the pipe line. Seen as a section in the longitudinal direction of the threaded parts, each thread flank is for this purpose provided with pairs of adjacent, skewed plane surfaces meeting in a single contact point, extending into the thread opening, whilst the thread crest and thread root is plane. In such way a locking effect against radial movement of a pipe with respect to the jointed pipe is achieved.

U.S. Pat. No. 4,004,832 describes a casing coupling having internally arranged threads to be used for jointing adjoining ends of two drill string sections. The drill string sections are at each end provided with a tapered end, provided with externally arranged threads configured to cooperate with the internally arranged threads of the coupling. The threads have thread crests and thread roots forming circular arcs and having a short flank, giving the threads an open shape.

U.S. Pat. No. 2,909,380 describes a corresponding thread shape where the thread crests and the thread roots are formed of circle arcs and where the intermediate flanks are inclined, providing an open thread shape.

NO 20083915, which belongs to the applicant and which is hereby included by the reference with respect to the use of deformable metal seals, discloses a gas tight pipe shaped coupling or joint used in connection with production of oil and/or gas, where the pipes are manufactured of tubular sections and where said sections, after being interconnected at their respective ends, are finally formed by expansion. The pipes are formed from at least two sections, one outer tubular section and one inner tubular section. The ends of each section are overlapping the ends of the next, succeeding section, whereby one or more of the inner. Intermediate or outer tubular sections are of different metallic materials and/or different thickness. Under the deformation process the sections are deformed plastically in the overlapping zone, forming a metallic seal and thereby providing gas pressure integrity between the inside and outside of the expanded pipe.

SUMMARY

An object of the present invention is to provide an improved threaded joint between a threaded male end of a casing or liner and the corresponding threaded end of a female end.

Another object of the invention is to provide a joint which remains intact and gas tight both in the phase prior to expansion, during the expansion and also after the expansion of a pipe string formed of a number with pipes provided with threads according to the present invention, the threads being designed to expand in radial direction.

A further object of the invention is to provide a solution which also is suitable for withstanding axial tensional and/or compressive loads during running of the pipe string down into for example a deviated well.

A still further object of the present invention is to eliminate, or at least reduce the possibilities for unintentional separation in the threaded part/during expansion or subsequent operation as a consequence of tension, compression, expansion or contraction in radial and/or axial direction of a pipe made up with joints. This effect is in particular effective for steel having a considerable deformation hardening, such as high-alloy austenitic chromium/nickel steel.

Another object of the joint is to prevent the end of the threaded male unit of the joint to be curved inwards towards the center of the pipe as a consequence of the "end effect" which an expanded pipe end is subjected to.

An even further object of the solution according to the present invention is to provide a solution where the threads are configured in such way that the foot of each tooth will be subjected to loads contributing to improved fastening, since the deformation is concentrated at this part of the threads and that the loads are distributed over a larger part of the dent inwards towards the bulk and outward towards the tooth end.

It is also an object to remove as many hot spots in the threads as possible by making the threads rounded. In such way the probability of failure during expansion and appearance of fatigue during operation are reduced.

Yet another object of the invention is to provide a design of expandable pipe ends which in a simple manner may be jointed by screwing one end into another end for establishing a strong and gas tight joint.

Embodiments of the invention are defined by the dependent claims.

According to the present invention those parts of the pipe being provided with threads are provided with threads having at least two step wise parts with a cylindrical surface, each being coaxially arranged with respect to the pipe wall(s). The distance between adjacent threads at their widest point is less than the maximum width of a thread. This ensures that when threads are engaged, they resist movement in a radial direction relative the pipe as well as in an axial direction, which improves the quality of seal when the pipe is expanded.

The threaded parts may preferably be formed of at least four concentric surfaces having decreasing thickness in direction towards the end(s) of the pipe, wherein the threads preferably have a circular or oval formed thread root and thread crest with a curvature like a radius.

The circular shaped thread root and thread crest may preferably have a radial curvature, and the transition between two adjacent thread root and thread crest between two adjacent threads may preferably be curved and changes direction in one turning point.

According to an embodiment the thread root and the thread crest may have coinciding tangents at one point and the height (h) between the thread root and the thread crest may for example be less than two times the diameter of the circle. The distance (h) between the crest point of a thread and the root point of an adjacent thread may further be governed by the formulae $h=ab_1/2$, where a is a constant which governs the slenderness factor $b_2/b_1$ and where $b_1$ is the distance between two adjacent thread side walls of the two walls having coinciding, common tangents, while $b_2$ is the smallest distance between two adjacent thread flanks, and where h may be approximately equal to $3b_1/2$.

According to one embodiment of the invention, a sealing element may, in respect to the part of the male end intended to be positioned far in the screwed-in position, be arranged as a substitution of the threads along a portion of this step. The position of said sealing on this step may preferably lie as far away from the free end of the male end as possible.

Further, said seal may preferably be in the form of a soft material, preferably metal, such as for example silver. Further, the seal may be provided with weakened parts or recesses, providing room filling and a positive pressure on the pipe wall of the male end subsequent to the finally applied formation of tension.

According to a further embodiment each pipe end may at the opposite, external end surface of the screw joint be provided with a skewed end surface contributing to preventing the free end of the female part from moving outwards during the expansion of the thin walled, assembled pipe joint. The final bending of the pipe wall will generate a pressure between two adjacent skewed surfaces. In this way a compression over a relatively small area will appear, so that the compressive strain will provide the required sealing.

The threads according to the present invention secure a joint against completely or partly separating during the large deformation which the joint/threaded parts are subjected to during expansion of the pipe. In this way the functionality of the joint will best be secured also subsequent to the expansion, the joint having sufficient capacity to withstand compression, tension, burst and collapsing.

According to the present invention each tooth, where the tooth is thinnest, is subjected to further local loads in each thread when the yield stress has been reached without failure occurring instantaneously. One reason for this is that the material in this part of the thread is work hardened due to the deformation, that to say that the yield strength of the material is increased when it becomes deformed. The reason for work hardening is that the material is built up of atoms arranged in a defined pattern with respect to each other in a specific grid pattern. This structure will due to different reasons have a grid error, so called dislocations. During the deformation, dislocations will drive the deformation through so that the material more easily deforms in grid error, while at the same time new dislocations are formed. Dislocations are accumulated in clusters, which again will prevent further movement of dislocations together with particles, enclosures, crystal boundaries, etc. providing larger resistance against further deformations, thus giving the material larger tensile strength.

According to the present invention it has proved necessary that the threads are positioned parallel with the axis of the pipes and movement during screwing. In order to increase the strength and tightness of the joint a stepped configuration is used, i.e. each threaded end has one or more stepped sections. In addition, with respect to the regions of the threaded joint being subjected to the largest movement and change of shape, adjustments securing that the threaded joint remains gas tight also during and after completed expansion is arranged.

By using a seal according to the present invention, arranged at least at the free end of the male plug, a solution which also remains gas tight during and subsequent to the expansion of the casing is achieved.

DETAILED DESCRIPTION

Figure 1:
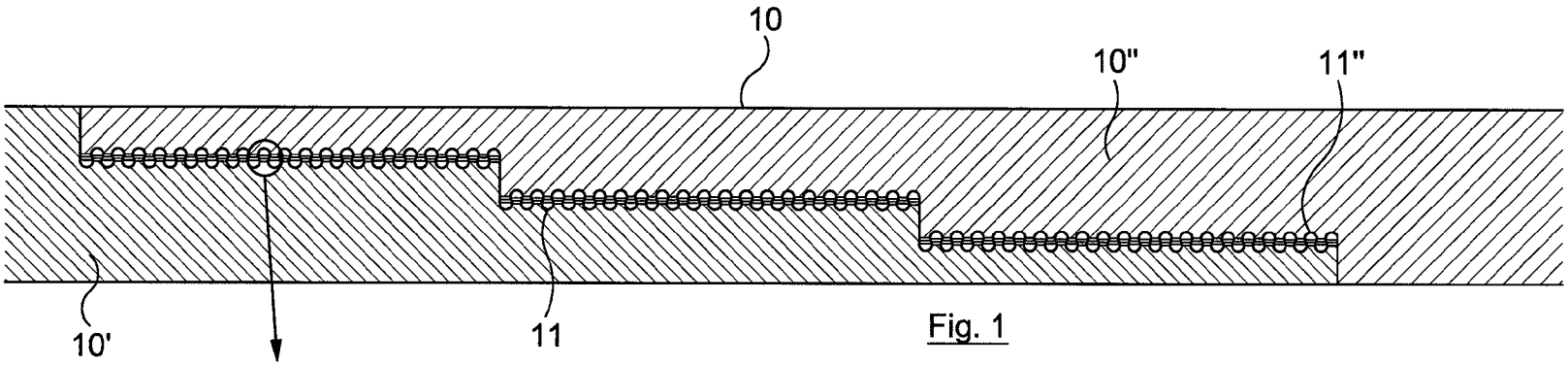
FIG. 1 shows schematically a vertical section through a section of a threaded joint between two adjoining pipe walls in a liner.

FIG. 1 shows schematically two ends of two casing sections 10 which are screwed together. As shown in the Figure, one casing section 10" is provided with a female end having internally arranged threads 11" and a casing section 10' provided with a male end equipped with externally arranged threads 11'. As further indicated both the male end 10' and the female end 10" are equipped with three different threaded surfaces which co-act and where each thread surface 11', 11" is established on cylindrical and concentric surfaces which are lengthwise displaced with respect to each other in the longitudinal direction of the pipes 10', 10". Such configuration of the threads makes it possible to screw the male end into the female end. According to the embodiment shown, the heights of the steps between two adjacent concentric, threaded surfaces are equal. It should be noted, however, that the height of the steps may vary, provided that corresponding variation also exits on the corresponding adjoining pipe end. Further, the Figure shows a solution where the steps are perpendicular with respect to the symmetry axis of the pipe. It should be noted, however, that said stepped surfaces may be sloped in one or the other direction with respect to said perpendicular.

The expandable pipe 10' which is configured to be screwed onto or off an adjoining expandable pipe 10" is, at one end of the pipe 10' provided with a male end having externally arranged threads, while the corresponding adjoining expandable pipe 10" is provided with a correspondingly shaped female end provided with corresponding internally arranged threads. The threads have a circular or oval shaped thread root and thread crest. The circular shape of the thread root and thread crest ensures that the distribution of stress around the thread is maximised, preventing points of high localised stress concentration that would otherwise increase the risk of cracking. This is particular useful give that, during a pipe expansion operation, the pipe and its threads are placed under stress that is close to the ultimate tensile strength (UTS) of the pipe.

As shown in FIG. 1 the surface onto which the threads 11', 11" are arranged is arranged in parallel with the axis of each pipe 10', 10" and parallel with the direction of motion when screwing in. As shown, each end is further provided with three separate screw surfaces with intermediate steps. Even though three separate surfaces are shown, it should be noted that this number may be one or several—the more steps, the closer will the strength of the joint be the strength of the pipe itself.

The transition between adjacent thread roots and thread crests between adjacent threads is curved and changes direction in one distinct turning point.

Both the thread root and the thread crest may preferably, but not necessarily, have a coinciding tangent in one point.

Figure 2:
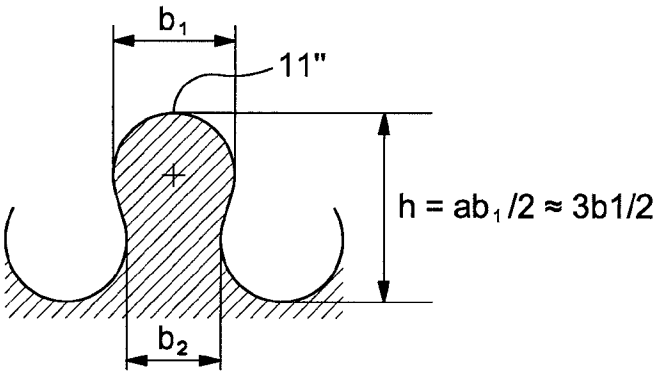
FIG. 2 shows schematically a part in enlarged scale of a threaded joint between a thread crest and two thread roots respectively.

According to an embodiment as shown in more detail in FIG. 2, the threads have a circular shape, and the height (h) between the thread root and the thread crest is less than twice the diameter of the circle. The maximum width of the thread root and maximum width ($b_1$) of the thread crest is larger than the smallest distance ($b_2$) between two adjacent thread walls. In other words, the distance between adjacent threads (11") at their widest point is less than the maximum width of a thread (11'). In this way, the threads when screwed together can be considered to be "closed", as they will resist movement in a radial direction relative the pipe as well as in an axial direction.

The distance (h) between the crest point of one thread and the root point of an adjacent thread is for circular threads given by the formulae $h=ab_1/2$, where a is a constant governing the slenderness factor $b_2/b_2$ and where $b_1$ is the distance between two adjacent thread side walls at the two points with coinciding common tangent, while $b_2$ is the minimum distance between two adjacent thread sides. Correspondingly, h may be approximately $3b_1/2$.

According a specific embodiment $b_1$ is in the order of 2 mm, while a varies around 3 within the range <2.4> (for example 2.5, 2.75, 3, 3.25 and 3.5 if this has any meaning from a geometrical point of view). The pipe material may for example be an austenitic steel with a yield at ca. 200 MPa and fracture around 1000 MPa with extension ca 50%. Simultaneously, the pipes may have an axis symmetry.

Figure 3:
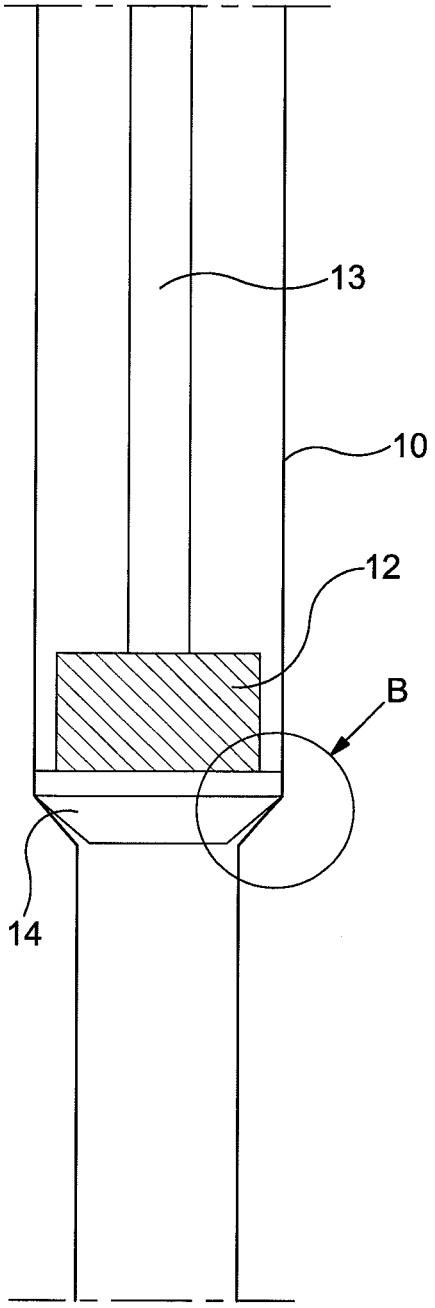
FIG. 3 shows schematically a section through a casing which is subjected to an expansion.

FIG. 3 shows schematically a section through a pipe 10 which is expanded by means of an expansion plug 12, pressed down through the casing by means of a tool string 13. The expansion plug 12 is at its lower end provided with an expansion body 14 having conical surface where the lower diameter is less than the larger, upper diameter. When the expansion body 14 is pressed down the thin walled casing 14, the casing 14 is expanded radially outwards, so that the diameter of the pipe is increased.

Figure 4:
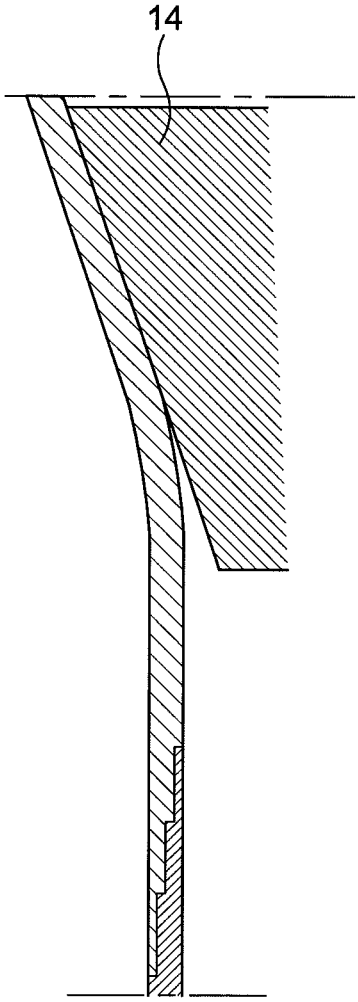
FIG. 4 shows schematically in enlarged scale, a joint just prior to being exposed to an expansion.

FIG. 4 shows schematically a pipe joint with threads according to the invention just prior to arrival of the body 14 with the expanding surface at the joint, while FIG. 5 shows the joint in the phase where the joint is in the expansion phase. As indicated in these Figures, the threads 11', 11" become bent and stretched at least twice in the plane drawn. The first time appears in the moment when the conical surface on the expanding tool 12 forces the material in the wall of the pipe section 10',10" and the screwed joint out from the unexpanded diameter to the maximum expanded diameter. The second time the screwed joint is bent is in the phase where the expansion tool 12 has passed the pipe joint, and where the pipe 10', 10" is bent somewhat back, and then again is stretches out upon completed expanding. Dependent on the geometry of the expansion tool and the material in the pipe and pipe geometry, smaller bending processes may appear between said two bendings.

Figure 5A:
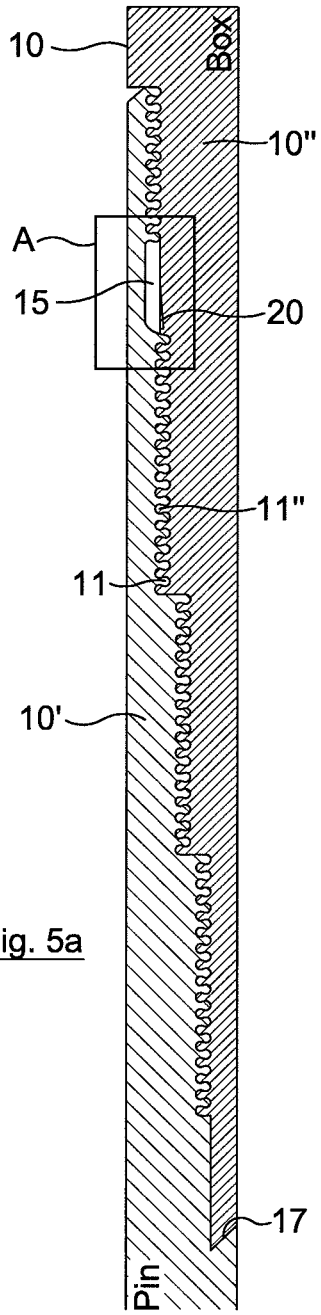
FIG. 5*a* shows an embodiment of a joint where the a metal ring is used as an additional sealing.
Figure 5B:
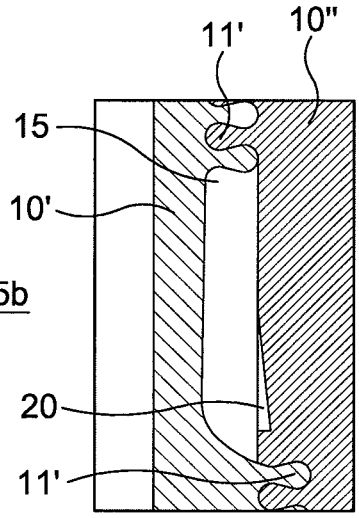
FIG. 5*b* shows a portion marked A in FIG. 5*a;*
Figure 5C:
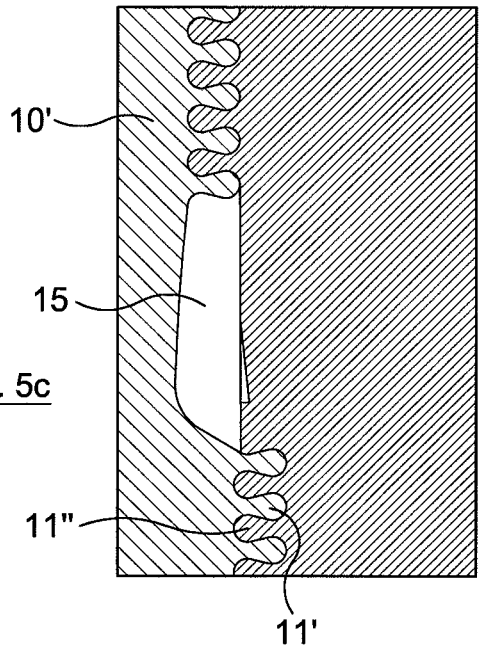
FIG. 5*c* is intended schematically to illustrate the deformation of the threads of a joint, resulting from a simulated expansion.

FIG. 5*a* shows an embodiment of a joint where a metal ring 15 is used as an extra sealing, which will be described in further details below. In respect to that part of the male end on which the metal ring rests, a small recess 20 may be made for receipt of deformed metal from the ring 15. FIG. 5*b* shows a part marked A in FIG. 5*a*, while FIG. 5*c* indicates further that the threaded joint at the free end area of the male end 10" during passage of the expansion body 12 is exposed to a force which tends to split or separate the threaded joint. A corresponding, although smaller splitting effect, also appears at the opposite end of the threaded joint.

Figure 6:
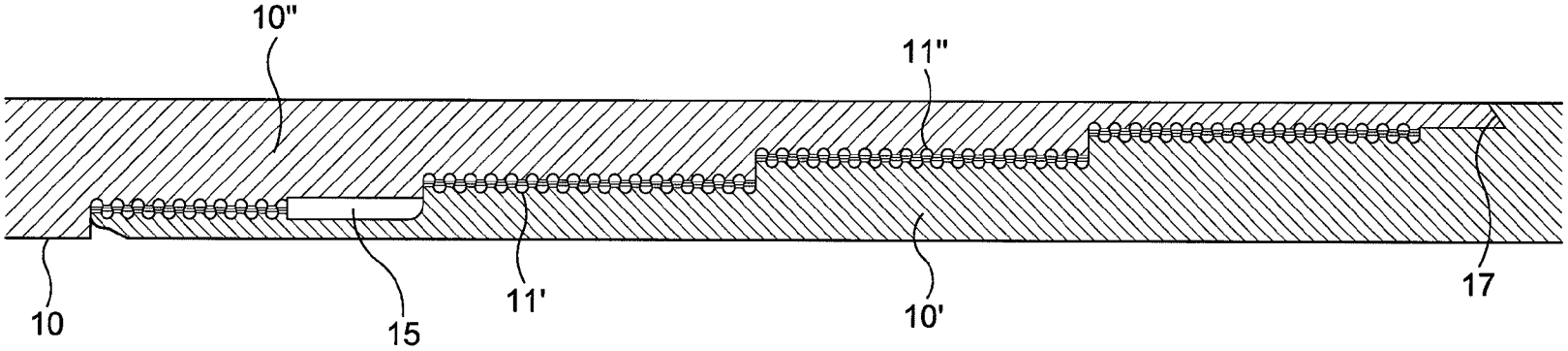
FIG. 6 shows schematically a portion of a threaded joint provided with a means for securing gas tightness in the joint also subsequent to an expansion.
Figure 7:
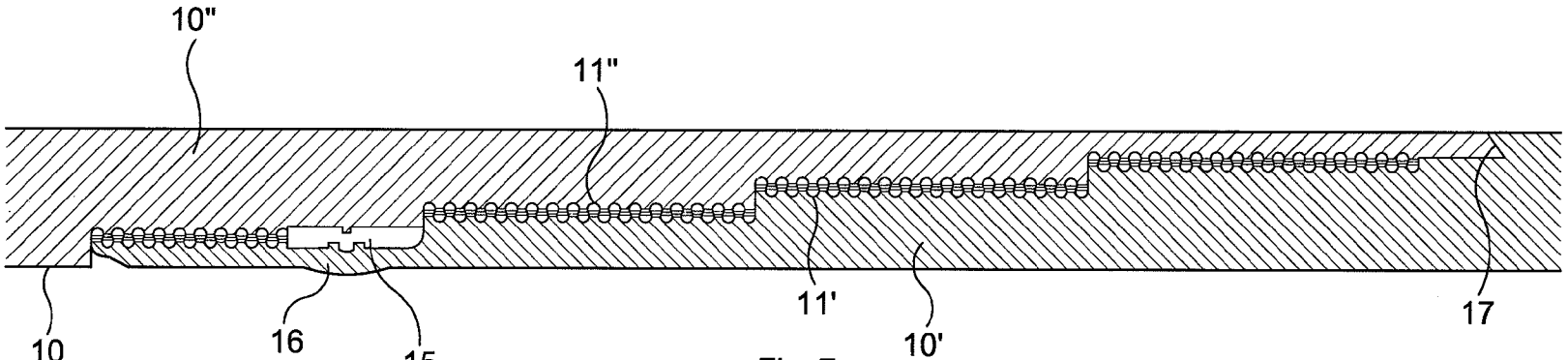
FIG. 7 shows schematically details of an alternative embodiment of the means for securing the gas tightness of the joint.

FIGS. 6 and 7 show an embodiment for ensuring that the splitting effect does not cause any unintentional leakage of gas out of/into the pipe. At the free end of the threaded joint a ring 15 of a soft material, such as for example silver, is arranged for this purpose. At the place where this ring is arranged on the cylinder surface, the threads 11', 11" are removed. For this solution it may be desirable to obtain a chemical or metallurgical bonding, for example a connection between a metal having little deformation resistance, creating a metal bonding with the material in the pipe wall 10'10". Alternatively, it may be strived to obtain a chemical reaction between the adjoining metal surfaces coming in close contact with each after the expansion. As shown in FIGS. 6 and 7 the seal is preferably placed at the inner edge against the first step.

FIG. 7 shows a variant of said ring 15. The geometry of the ring 15 is configured in such way that it provides full space filling and a positive pressure on to the adjoining material at the male end after the yield deformation. The ring is for this purpose provided with recesses on each side, with two recesses arranged in spaced relation on the side of the ring 15 lying nearest the pipe opening. On the opposite side of the ring, between said two recesses, another recess is also arranged. In addition, the wall of the pipe 10' is in connection to said recesses also provided with an inwards projecting bead 16, which during expansion contributes to pressing the ring causing a compression of the ring 15, improving the sealing effect. When the cone 14 is passing the ring 14, the cone will cause a corresponding deformation, establishing a bonding as specified above. Also the embodiment shown in FIG. 6 may possibly be provided with a bead 16 in order to secure a good sealing against unintentional leakage of fluid through the hinged joint.

In order to provide sufficient or as large stretching or deformation in this region the oxide layer of the metal will result in a bonding between the metals which will be difficult to break. The use of such bonding may contribute to making the joint even tighter.

It should be noted that a fluid tight joint is in this respect understood to mean a sealing allowing a maximum leakage of a few millimeter per minute, and preferably no leakage at all.

An object of the recesses 15 and the bead 16 is to ensure that the deformation, as a consequence of the stretching caused by the expansion due to the cone 14 passing the threaded joint, will result in sufficient residual tension in the joint so that the joint remains tight. This shape, which according to the embodiment shown is placed at the male end, may optionally be placed at the corresponding female end, in the form of internally arranged recesses in the threaded portion of the female end.

The ring or the sealing 15 may preferably be placed in a milled out groove in the threaded portion. The sealing 15 may for example be split in two or three sectors or parts, so that it easily may be put in place. The threads 11', 11" at the two ends are the screwed together, whereby the sealing or the ring 15 will be completely surrounded or locked in. There will, however, be a certain slack around the sealing due to production tolerances and possibly also intended and preferred dimensioning. In order to possibly compensate for such slack, the pipe 10' may at the male end be formed with an internally arranged bead or thickened part 16, arranged internally in the pipe 10 in the region of the ring, so that this extra metal volume inside the ring or sealing 15 will press the ring additionally together when the cone is passing. The sealing 15 will then fill its space.

At the opposite end of the threaded joint the inner step 17 is inclined in direction towards the threaded joint while the outer, free end of the female en is correspondingly inclined, so that this end in threaded position is locked against radial movement outwards during the expansion. Here it may be appropriate with a slight difference in the angles of the two adjoining, inclined surfaces, so that the strain becomes slightly larger in the region where the surfaces firstly come into contact—most often the tip.

According to the embodiments shown, a joint having four steps is disclosed. The number of steps or shoulders may, however, be higher or lower without thereby deviating from the inventive idea. In this context it should be noted that the number of steps or shoulders is of importance for the strength of the joint. The more step, the smaller height of each shoulder or step is required, since the forces are transferred through the threads between each shoulder. The length of each individual threaded portion should be so long that the forces are transferred without substantial bending moment. For example, the length may be three times the thickness of the thinnest thread body. The length of the joint are not necessarily decisive as long each step is optimal. The length should, however, be as small as possible, so that the region which is weakened due to the joint, compared with the strength of the pipe, is as small as possible.

The invention claimed is:

1. An expandable pipe section, intended to be joined with an adjoining expanding pipe section and for use in connection with a well casing in a production well for hydrocarbons, wherein the pipe section is configured to be screwed on or off the adjoining expandable pipe section, the expandable pipe section at one end being provided with a male end having externally arranged threads and the adjoining expandable pipe section being provided with a correspondingly shaped female end having corresponding internal threads, wherein a distance between adjacent threads at the widest point of the threads is less than the maximum width of a thread, wherein those parts of the pipe being provided with threads are formed of at least two parts, each with a cylindrical surface being coaxially arranged with the pipe wall(s), and wherein the cylindrical surface of a first part of said at least two parts has a radius which is smaller than the radius of the cylindrical surface of a second part of said at least two parts.

2. The expandable pipe section according to claim 1, wherein the threaded portions comprise at least four concentrically arranged surfaces having diminishing thickness in direction towards the end(s) of the pipe.

3. The expandable pipe section according to claim 1, wherein the threads have a circular shaped thread root and thread crest with a curvature with equal radius.

4. The expandable pipe section according to claim 3, wherein a transition between adjacent thread root and thread crest is curved and changes direction in one turning point.

5. The expandable pipe section according to claim 3, wherein the thread root and thread crest have coinciding tangents in one point.

6. The expandable pipe section according to claim 3, wherein a height, h, between the thread root and thread crest is less than two times the diameter of the circle of the circular shaped thread root and thread crest.

7. The expandable pipe section according to claim 6, wherein the height, h, between the crest of a thread and a bottom point on an adjacent thread is governed by the formulae $h=ab_1/2$, where a is a constant governing the slenderness factor $b_2/b_1$ and where $b_1$ is the distance between two adjacent thread side walls of of two points having coinciding common tangent, while $b_2$ is the minimum distance between two adjacent thread sides.

8. The expandable pipe section according to claim 6, wherein h is approximately equal to $3b_1/2$.

9. The expandable pipe section according to claim 1, wherein the expandable pipe section is expandable by means of an expansion plug, and the connection with the part of the expansion plug, which is arranged to be in an extreme inner position when a sealing element is assembled, is provided with sealing element in a milled part of the thread along the length of this step.

10. The expandable pipe section according to claim 9, wherein the position of said sealing element on this step is furthest away from the end of the expansion plug.

11. The expandable pipe section according to claim 9, wherein the sealing is in the form of a soft metal having reduced resistance against change in form, compared with the metal in the pipe.

12. The expandable pipe section according to claim 9, wherein the sealing is provided with weakened parts or recesses providing filling of space and a positive pressure on the pipe wall of the male expansion plug subsequent to the last yield deformation.

13. The expandable pipe section according to claim 9, wherein the sealing is configured to establish a collapse of the oxide layer on the surface of the sealing metal and the metal in the pipe walls, so that bonding is formed between said metal surfaces.

14. The expandable pipe section according to claim 1, wherein an end of the pipe is provided with an inclined end surface which is arranged to prevent the free end of the female part from moving outwards during the expansion of the assembled pipe.

15. The expandable pipe section according to claim 1, wherein the pipe section is thin walled.

16. The expandable pipe section according to claim 4, wherein the thread root and thread crest have coinciding tangents in one point.

* * * * *